US010653279B2

(12) United States Patent
Wright

(10) Patent No.: US 10,653,279 B2
(45) Date of Patent: May 19, 2020

(54) MASSAGING AND SCRUBBING DEVICE

(71) Applicant: Errol Wright, Golden Valley, MN (US)

(72) Inventor: Errol Wright, Golden Valley, MN (US)

( * ) Notice: Subject to any disclaimer, the term of this patent is extended or adjusted under 35 U.S.C. 154(b) by 446 days.

(21) Appl. No.: 15/591,920

(22) Filed: May 10, 2017

(65) Prior Publication Data

US 2018/0325328 A1 Nov. 15, 2018

(51) Int. Cl.

| | |
|---|---|
| ***A47K 7/03*** | (2006.01) |
| ***A46B 11/00*** | (2006.01) |
| ***A61H 7/00*** | (2006.01) |
| ***A46B 5/00*** | (2006.01) |
| ***A47K 7/04*** | (2006.01) |
| ***A46B 13/04*** | (2006.01) |

(52) U.S. Cl.

CPC ..... *A47K 7/03* (2013.01); *A46B 5/0012* (2013.01); *A46B 11/002* (2013.01); *A46B 11/0062* (2013.01); *A46B 13/04* (2013.01); *A47K 7/043* (2013.01); *A61H 7/005* (2013.01); *A46B 2200/102* (2013.01); *A46B 2200/1006* (2013.01); *A61H 2201/0157* (2013.01); *A61H 2201/105* (2013.01); *A61H 2201/1207* (2013.01); *A61H 2201/1223* (2013.01); *A61H 2201/1685* (2013.01); *A61H 2201/1692* (2013.01); *A61H 2201/5053* (2013.01)

(58) Field of Classification Search

CPC . A47K 7/04; A47K 7/03; A47K 7/043; A47K 7/005; A46B 5/0012; A46B 11/002; A46B 11/0062; A46B 13/04; A46B 2200/1006; A46B 2200/102; A61H 7/005; A61H 2201/0157; A61H 2201/105; A61H 2201/1207; A61H 2201/1223; A61H 2201/1685; A61H 2201/1692; A61H 2201/5053

USPC ..... 601/17

See application file for complete search history.

(56) References Cited

U.S. PATENT DOCUMENTS

| | | | | |
|---|---|---|---|---|
| 1,458,371 A | | 6/1923 | Sterrick | |
| 2,514,934 A | * | 7/1950 | Delle Chiaie | A46B 15/00 239/240 |
| 4,229,116 A | * | 10/1980 | Moore | A46B 11/0013 401/140 |
| 5,385,532 A | | 1/1995 | Shyu | |

(Continued)

FOREIGN PATENT DOCUMENTS

WO WO2007143167 12/2007

*Primary Examiner* — Bradley H Philips
*Assistant Examiner* — Savannah L Gabriel

(57) ABSTRACT

A massaging and scrubbing device for massaging and cleansing a user includes a housing that defines an internal space. A plurality of brushes is rotationally coupled to a front of the housing. A handle is coupled to and extends from the housing. The handle is hollow. A rotator is coupled to the housing and is positioned in the internal space. The rotator is selectively operationally couplable to the plurality of brushes. The rotator is positioned to rotate the brushes to massage the user. At least one orifice is positioned through the front of the housing. A dispenser is coupled to and positioned in the handle. The dispenser is fluidically coupled to the at least one orifice. The dispenser is configured to selectively compel liquid soap through the at least one orifice to lather the user.

18 Claims, 4 Drawing Sheets

(56) References Cited

U.S. PATENT DOCUMENTS

| | | | | |
|---|---|---|---|---|
| 5,500,971 | A * | 3/1996 | Springmann | A46B 13/02 15/23 |
| 5,784,744 | A * | 7/1998 | Toran | A46B 13/04 15/29 |
| 6,170,108 | B1 * | 1/2001 | Knight | A46B 13/008 15/29 |
| 7,503,715 | B2 | 3/2009 | Khubani | |
| D615,714 | S | 5/2010 | Matz et al. | |
| 8,713,739 | B1 * | 5/2014 | Alas | A46B 5/0095 15/28 |
| 2003/0142512 | A1 * | 7/2003 | Klearman | A44C 15/0015 362/104 |
| 2005/0138740 | A1 * | 6/2005 | Alfano | A46B 13/008 15/22.1 |
| 2007/0095362 | A1 | 5/2007 | Koopah | |
| 2015/0128363 | A1 | 5/2015 | Cooper et al. | |
| 2015/0190299 | A1 * | 7/2015 | Jurna | A61H 7/005 601/114 |

* cited by examiner

MASSAGING AND SCRUBBING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to scrubbing devices and more particularly pertains to a new scrubbing device for massaging and cleansing a user.

BRIEF SUMMARY OF THE INVENTION

An embodiment of the disclosure meets the needs presented above by generally comprising a housing that defines an internal space. A plurality of brushes is rotationally coupled to a front of the housing. A handle is coupled to and extends from the housing. The handle is hollow. A rotator is coupled to the housing and is positioned in the internal space. The rotator is selectively operationally couplable to the plurality of brushes. The rotator is positioned to rotate the brushes to massage a user. At least one orifice is positioned through the front of the housing. A dispenser is coupled to and positioned in the handle. The dispenser is fluidically coupled to the at least one orifice. The dispenser is configured to selectively compel liquid soap through the at least one orifice to lather the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
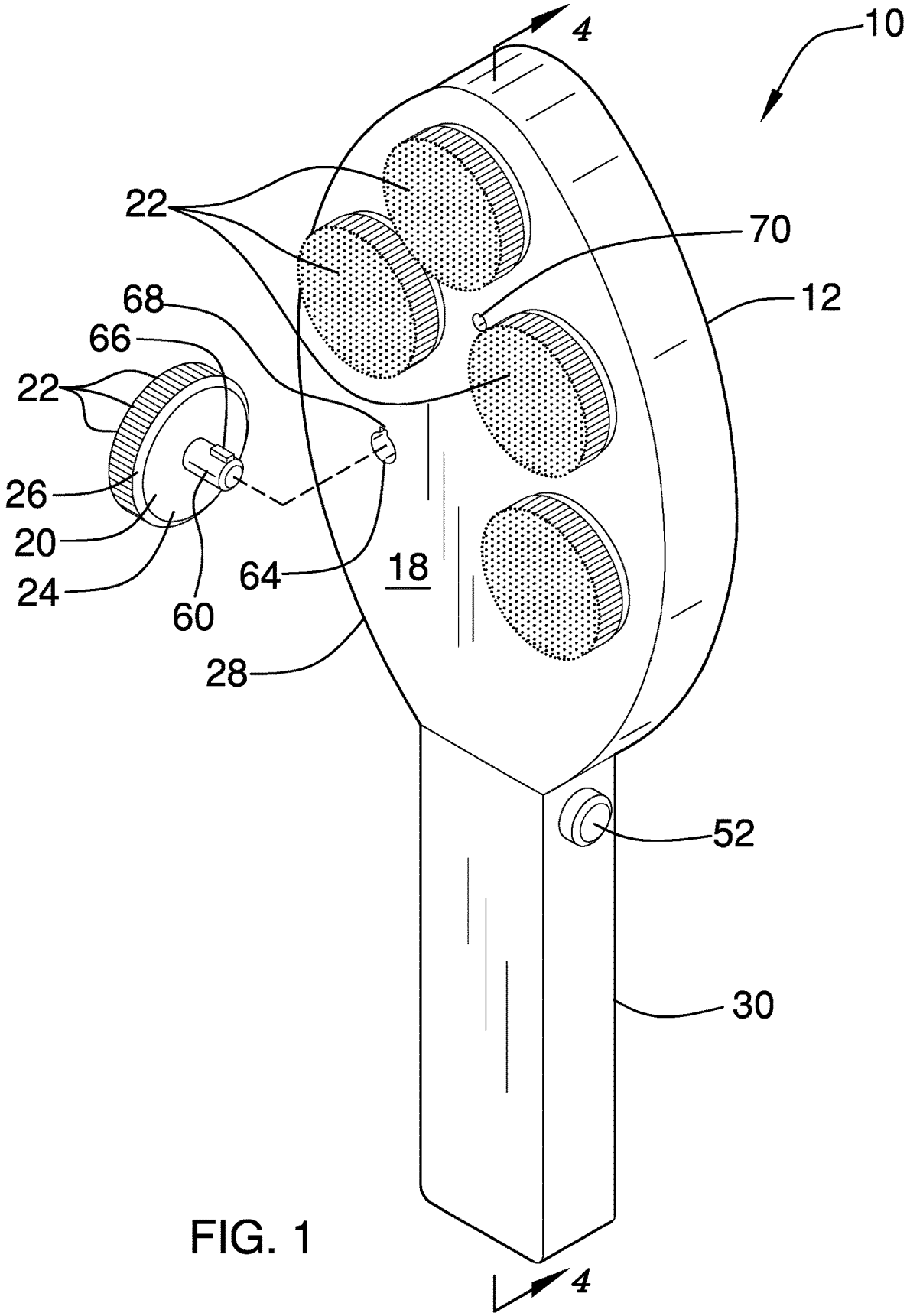
FIG. 1 is an isometric perspective view of a massaging and scrubbing device according to an embodiment of the disclosure.
Figure 2:
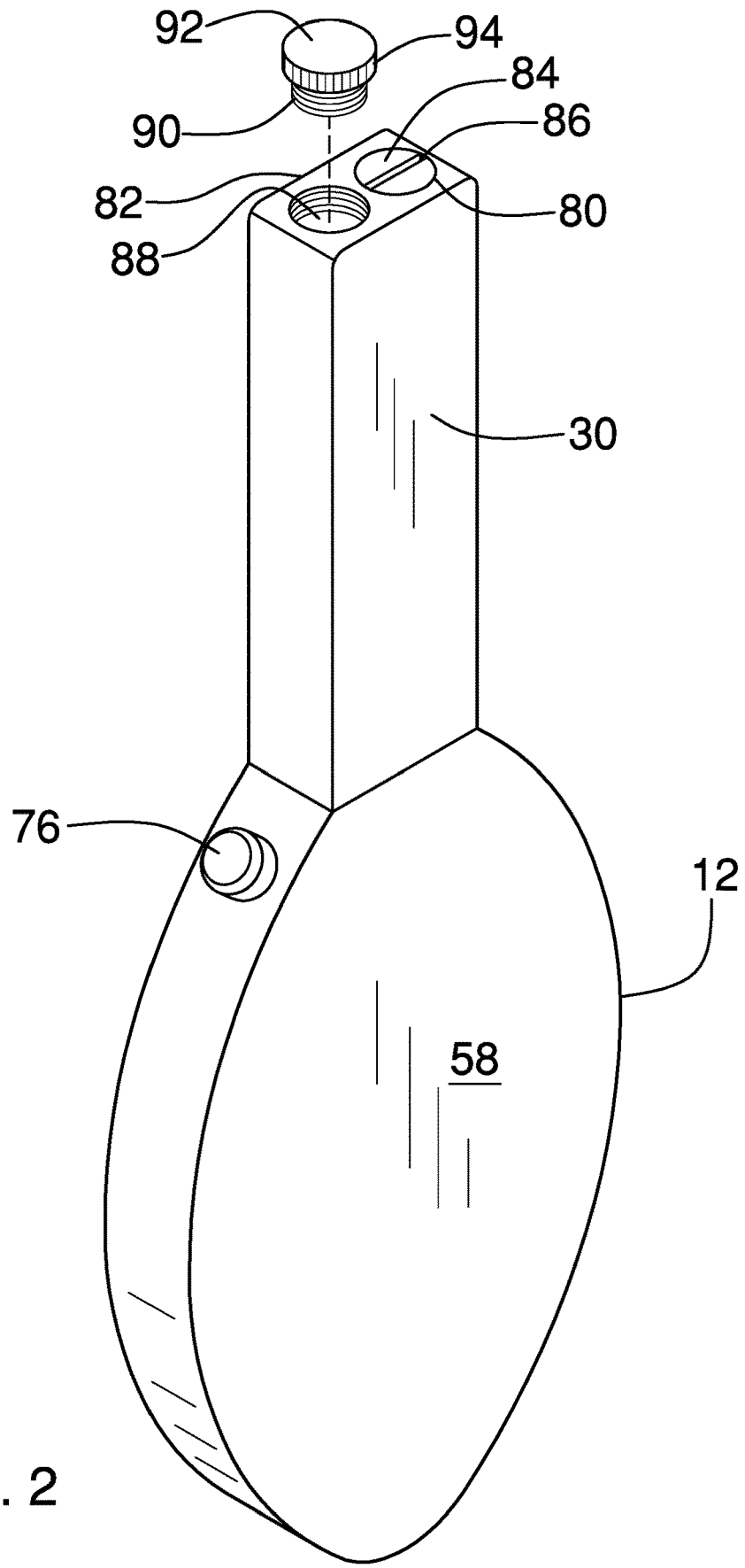
FIG. 2 is an isometric perspective view of an embodiment of the disclosure.
Figure 3:
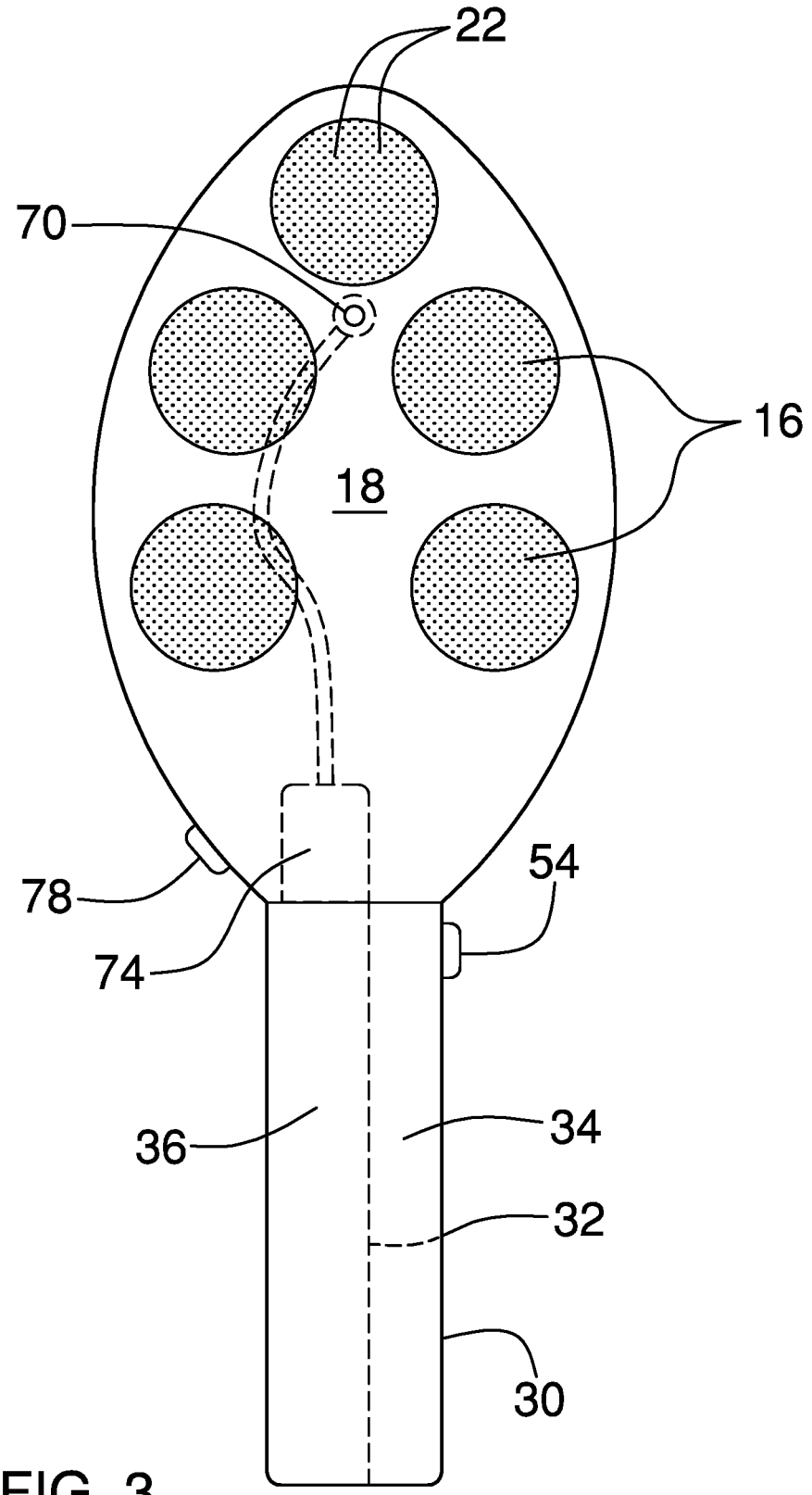
FIG. 3 is a front view of an embodiment of the disclosure.
Figure 4:
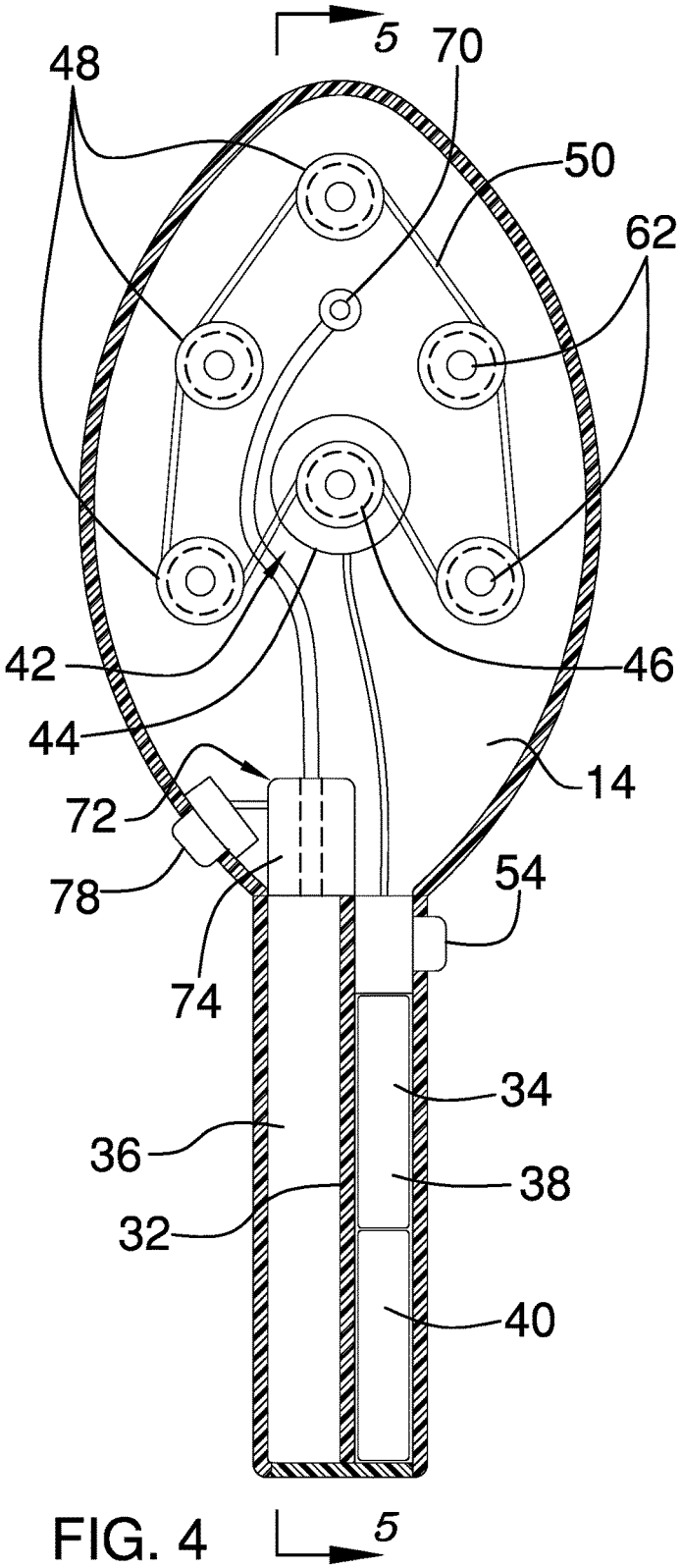
FIG. 4 is a cross-sectional view of an embodiment of the disclosure.
Figure 5:
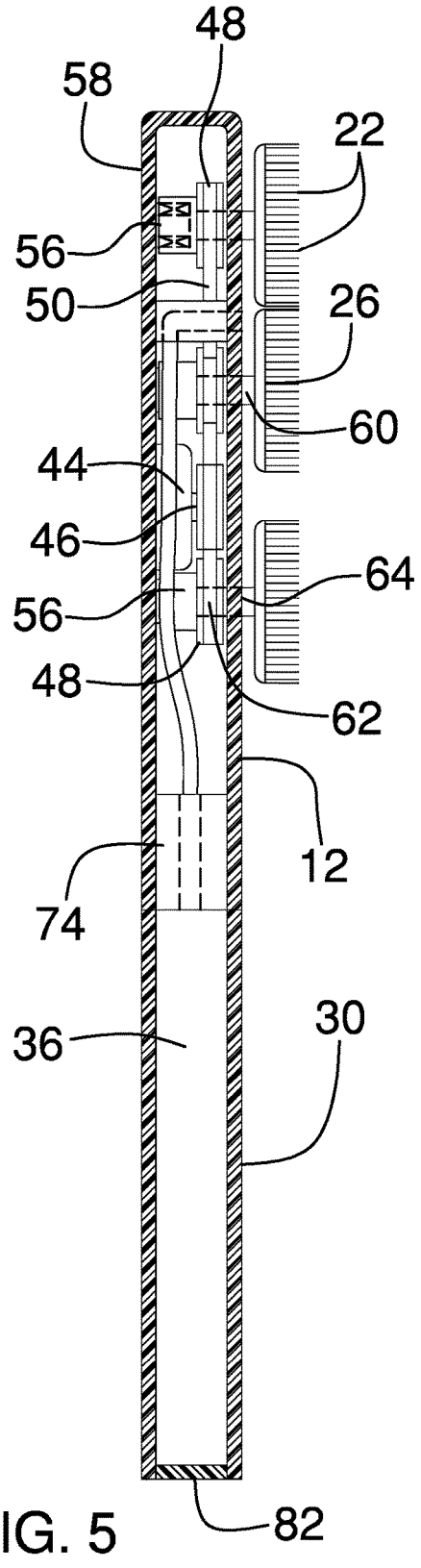
FIG. 5 is a cross-sectional view of an embodiment of the disclosure.

With reference now to the drawings, and in particular to FIGS. 1 through 5 thereof, a new scrubbing device embodying the principles and concepts of an embodiment of the disclosure and generally designated by the reference numeral 10 will be described.

As best illustrated in FIGS. 1 through 5, the massaging and scrubbing device 10 generally comprises a housing 12 that defines an internal space 14. In one embodiment, the housing 12 is substantially oblong ovally shaped. In another embodiment, the housing 12 is substantially water-tight. In yet another embodiment, the housing 12 comprises plastic.

A plurality of brushes 16 is rotationally coupled to a front 18 of the housing 12. In one embodiment, each brush 16 comprises a disc 20 and a plurality of bristles 22. The disc 20 is axially and rotationally coupled by a first face 24 to the housing 12. The bristles 22 are coupled to and extend from a second face 26 of the disc 20. In one embodiment, the plurality of brushes 16 comprises five brushes 16 that are substantially evenly distributed around a perimeter 28 of the front 18 of the housing 12.

A handle 30 is coupled to and extends from the housing 12. The handle 30 is hollow. In one embodiment, the handle 30 is substantially rectangularly box shaped when viewed longitudinally. In another embodiment, the handle 30 is substantially water-tight. In yet another embodiment, the handle 30 comprises plastic. A wall 32 is coupled to and positioned longitudinally within the handle 30 to define a first chamber 34 and a second chamber 36.

A power module 38 is positioned in the first chamber 34. In one embodiment, the power module 38 comprises at least one battery 40. In another embodiment, the at least one battery 40 is rechargeable.

A rotator 42 is coupled to the housing 12 and is positioned in the internal space 14. The rotator 42 is selectively operationally couplable to the plurality of brushes 16. The rotator 42 is positioned to rotate the brushes 16. In one embodiment, the rotator 42 comprises a motor 44 that is coupled to the housing 12 and positioned in the internal space 14. The motor 44 is operationally coupled to the power module 38. A drive wheel 46 is axially coupled to the motor 44.

A plurality of pulleys 48 is coupled to the housing 12 and positioned in the internal space 14. Each pulley 48 is operationally coupled to a respective brush 16. The pulleys 48 are positioned on the brushes 16 such that each brush 16 is positioned to rotating coincidently with an associated pulley 48. A belt 50 is coupled to the drive wheel 46 and to each of the pulleys 48. The motor 44 is positioned to compel the brushes 16 to rotate coincidently with the drive wheel 46.

A first controller 52 is operationally coupled to the motor 44 and the power module 38. The first controller 52 is positioned to selectively couple the motor 44 to the power module 38 to rotate the brushes 16. In one embodiment, the first controller 52 comprises a first button 54. The first button 54 is depressible. The first button 54 is configured to be depressed a first time to couple the motor 44 to the power module 38. The first button 54 is configured to be depressed a second time to decouple the motor 44 from the power module 38. In one embodiment, the first button 54 is positioned on the handle 30 proximate to the housing 12.

A plurality of bearings 56 is positioned in the internal space 14. Each bearing 56 is coupled to and extends from a back 58 of the housing 12. The bearing 56 is operationally coupled to an associated pulley 48.

In one embodiment, each of a plurality of pins 60 is axially coupled to and extends from the first face 24 of a respective disc 20. Each of a plurality of first holes 62, which is complementary to the pins 60, is axially positioned in a respective pulley 48. A plurality of second holes 64 is positioned through the front 18 of the housing 12. Each second hole 64 is aligned with a respective first hole 62. The second holes 64 are positioned through the front 18 such that each second hole 64 is positioned to insert a respective pin 60 through the second hole 64 into the first hole 62 to reversibly couple a respective disc 20 to a respective pulley 48.

In another embodiment, each of a plurality of tabs 66 is coupled to and extends from a respective pin 60 distal from the disc 20. Each of a plurality of slots 68 extends from a respective second hole 64. The slots 68 are complementary to the tabs 66. Each slot 68 is positioned to insert a respective tab 66 as the pin 60 is inserted through the respective second hole 64.

At least one orifice 70 is positioned through the front 18 of the housing 12. A dispenser 72 is coupled to the housing 12 and positioned in the internal space 14. The dispenser 72 is fluidically coupled to the at least one orifice 70. The dispenser 72 is configured to selectively compel liquid soap through the at least one orifice 70. In one embodiment, the dispenser 72 comprises a pump 74 that is operationally coupled to the power module 38. The pump 74 is fluidically coupled to the second chamber 36 and the at least one orifice 70. The pump 74 is positioned to compel the liquid soap from the second chamber 36 through the at least one orifice 70 to the front 18 of the housing 12. The liquid soap is configured to lather a user.

A second controller 76 is operationally coupled to the pump 74 and the power module 38. The second controller 76 is positioned to selectively couple the pump 74 to the power module 38 to compel the liquid soap from the second chamber 36 through the at least one orifice 70 to the front 18 of the housing 12. The liquid soap is configured to lather the user. In one embodiment, the second controller 76 comprises a second button 78. The second button 78 is depressible. The second button 78 is configured to be depressed to couple the pump 74 to the power module 38. The second button 78 is configured to be released to decouple the pump 74 from the power module 38. In another embodiment, the second button 78 is positioned on the housing 12 proximate to the handle 30. In yet another embodiment, the second button 78 is opposingly positioned relative to the first button 54.

A first penetration 80 is positioned though an end 82 of the handle 30 distal from the housing 12. The first penetration 80 opens into the first chamber 34. The first penetration 80 is configured to allow access to the first chamber 34 to service the power module 38. A first cap 84, which is complementary to the first penetration 80, is reversibly couplable to the handle 30 to selectively open and close the first penetration 80. In one embodiment, the first penetration 80 is circularly shaped and internally threaded. In another embodiment, a slit 86 is positioned in the first cap 84. The slit 86 is complementary to a standard screw driver head. The slit 86 is configured to insert the head of the standard screw driver to reversibly couple the first cap 84 to the handle 30.

A second penetration 88 is positioned though the end 82 of the handle 30. The second penetration 88 opens into the second chamber 36. The second penetration 88 is configured to insert the liquid soap into the second chamber 36. A second cap 90, which is complementary to the second penetration 88, is reversibly couplable to the handle 30 to selectively open and close the second penetration 88. In one embodiment, the second penetration 88 is circularly shaped and internally threaded. In another embodiment, a knob 92 is coupled to the second cap 90. The knob 92 has a circumference 94 that is textured. The circumference 94 is configured to frictionally couple to one or more digits of a hand of the user. The knob 92 is configured to be grasped by the one or more digits of the hand of the user to reversibly couple the second cap 90 to the handle 30.

In use, the pulleys 48 are positioned on the brushes 16 so that each brush 16 rotates coincidently with the associated pulley 48. The first button 54 is configured to be depressed the first time to couple the motor 44 to the power module 38. The belt 50 is positioned on the drive wheel 46 and the pulleys 48 so that the motor 44 is positioned to compel the brushes 16 to rotate coincidently with the drive wheel 46. The first button 54 is configured to be depressed the second time to decouple the motor 44 from the power module 38. The second button 78 is configured to be depressed to couple the pump 74 to the power module 38. The pump 74 is positioned to compel the liquid soap from the second chamber 36 through the at least one orifice 70 to the front 18 of the housing 12. The liquid soap is configured to lather the user. The second button 78 configured to be released to decouple the pump 74 from the power module 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A massaging and scrubbing device comprising:

a housing defining an internal space;

a plurality of brushes rotationally coupled to a front of said housing;

a handle coupled to and extending from said housing, said handle being hollow;

a rotator coupled to said housing and positioned in said internal space, said rotator being selectively operationally couplable to said plurality of brushes;

at least one orifice positioned through said front of said housing;

a dispenser coupled to said housing and positioned in said internal space, said dispenser being fluidically coupled to said at least one orifice, said dispenser being configured for selectively compelling liquid soap through said at least one orifice;

wherein said rotator is positioned in said housing such that said rotator is positioned for rotating said brushes, wherein said dispenser is positioned in said housing such that said dispenser is configured for selectively compelling the liquid soap through said at least one orifice;

a wall coupled to and positioned longitudinally within said handle defining a first chamber and a second chamber;

a power module positioned in said first chamber; and wherein said rotator comprises a motor coupled to said housing and positioned in said internal space, said motor being operationally coupled to said power module, a drive wheel axially coupled to said motor, a plurality of pulleys coupled to said housing and positioned in said internal space, each said pulley being operationally coupled to a respective said brush, a belt coupled to said drive wheel and each of said pulleys, a plurality of bearings positioned in said internal space, each said bearing being coupled to and extending from a back of said housing, said bearing being operationally coupled to an associated said pulley, and wherein said pulleys are positioned on said brushes such that each said brush is positioned for rotating coincidently with an associated said pulley, wherein said belt is positioned on said drive wheel and said pulleys such that said motor is positioned for compelling said brushes for rotating coincidently with said drive wheel.

2. The device of claim 1, further including said housing being substantially oblong ovally shaped.

3. The device of claim 1, further including said housing and said handle being substantially water-tight.

4. The device of claim 1, further including said housing and said handle comprising plastic.

5. The device of claim 1, further including each said brush comprising a disc and a plurality of bristles, said disc being axially and rotationally coupled by said first face to said housing, said bristles being coupled to and extending from a second face of said disc.

6. The device of claim 1, further including said plurality of brushes comprising five said brushes substantially evenly distributed around a perimeter of said front of said housing.

7. The device of claim 1, further including said handle being substantially rectangularly box shaped when viewed longitudinally.

8. The device of claim 1, further including said power module comprising at least one battery.

9. The device of claim 8, further including said at least one battery being rechargeable.

10. The device of claim 1, further including a first controller operationally coupled to said motor and said power module, wherein said first controller is positioned for selectively coupling said motor to said power module for rotating said brushes.

11. The device of claim 10, further including said first controller comprising a first button, said first button being positioned on said handle proximate to said housing, said first button being depressible, wherein said first button is configured for depressing a first time for coupling said motor to said power module, wherein said first button is configured for depressing a second time for decoupling said motor from said power module.

12. The device of claim 1, further comprising:

a plurality of pins, each said pin being axially coupled to and extending from a first face of a respective said disc;

a plurality of first holes, said first holes being complementary to said pins, each said first hole being axially positioned in a respective said pulley;

a plurality of second holes positioned through said front of said housing; each said second hole being aligned with a respective said first hole;

a plurality of tabs, each said tab being coupled to and extending from a respective said pin distal from said disc;

a plurality of slots, each said slot extending from a respective said second hole, said slots being complementary to said tabs; and wherein said second holes are positioned through said front of said housing such that each said second hole is positioned for inserting a respective said pin through said second hole into said first hole for reversibly coupling a respective said disc to a respective said pulley, wherein said slots are positioned on said second holes such that each said slot is positioned for inserting a respective said tab as said pin is inserted through said respective said second hole.

13. The device of claim 11, further including said dispenser comprising a pump operationally coupled to said power module, said pump being fluidically coupled to said second chamber and said at least one orifice, wherein said pump is positioned in said housing such that said pump is positioned for compelling the liquid soap from said second chamber through said at least one orifice to said front of said housing such that the liquid soap is configured for lathering a user.

14. The device of claim 13, further including a second controller operationally coupled to said pump and said power module, wherein said second controller is positioned for selectively coupling said pump to said power module for compelling the liquid soap from said second chamber through said at least one orifice to said front of said housing such that the liquid soap is configured for lathering the user.

15. The device of claim 14, further including said second controller comprising a second button, said second button being positioned on said housing proximate to said handle, said second button being opposingly positioned relative to said first button, said second button being depressible, wherein said second button is configured for depressing for coupling said pump to said power module, wherein said second button is configured for being released for decoupling said pump from said power module.

16. The device of claim 1, further comprising:

a first penetration positioned though an end of said handle distal from said housing, said first penetration opening into said first chamber, wherein said first penetration is positioned in said handle such that said first penetration is configured for accessing said first chamber for servicing said power module, said first penetration being circularly shaped, said first penetration being internally threaded;

a first cap complementary to said first penetration, said first cap being reversibly couplable to said handle for selectively opening and closing said first penetration;

a second penetration positioned though said end of said handle, said second penetration opening into said second chamber, wherein said second penetration is positioned in said handle such that said second penetration is configured for inserting the liquid soap into said second chamber, said second penetration being circularly shaped, said second penetration being internally threaded; and a second cap complementary to said second penetration, said second cap being reversibly couplable to said handle for selectively opening and closing said second penetration.

17. The device of claim 16, further comprising:

a slit positioned in said first cap, said slit being complementary to a standard screw driver head, wherein said slit is positioned in said first cap such that said slit is configured for inserting the head of the standard screw driver for reversibly coupling said first cap to said handle; and a knob coupled to said second cap, said knob having a circumference, said circumference being textured such that said circumference is configured for frictionally coupling to one or more digits of a hand of a user, wherein said knob is positioned on said second cap such that said knob is configured for grasping by the one or more digits of the hand of the user for reversibly coupling said second cap to said handle.

18. A massaging and scrubbing device comprising:

a housing defining an internal space, said housing being substantially oblong ovally shaped, said housing being substantially water-tight, said housing comprising plastic;

a plurality of brushes rotationally coupled to a front of said housing, each said brush comprising a disc and a plurality of bristles, said disc being axially and rotationally coupled by a first face to said housing, said bristles being coupled to and extending from a second face of said disc, said plurality of brushes comprising five said brushes substantially evenly distributed around a perimeter of said front of said housing;

a handle coupled to and extending from said housing, said handle being hollow, said handle being substantially rectangularly box shaped when viewed longitudinally, said handle being substantially water-tight, said handle comprising plastic;

a wall coupled to and positioned longitudinally within said handle defining a first chamber and a second chamber;

a power module positioned in said first chamber, said power module comprising at least one battery, said at least one battery being rechargeable;

a rotator coupled to said housing and positioned in said internal space, said rotator being selectively operationally couplable to said plurality of brushes, wherein said rotator is positioned in said housing such that said rotator is positioned for rotating said brushes, said rotator comprising:

a motor coupled to said housing and positioned in said internal space, said motor being operationally coupled to said power module, a drive wheel axially coupled to said motor, a plurality of pulleys coupled to said housing and positioned in said internal space, each said pulley being operationally coupled to a respective said brush, wherein said pulleys are positioned on said brushes such that each said brush is positioned for rotating coincidently with an associated said pulley, and a belt coupled to said drive wheel and each of said pulleys, wherein said belt is positioned on said drive wheel and said pulleys such that said motor is positioned for compelling said brushes for rotating coincidently with said drive wheel;

a first controller operationally coupled to said motor and said power module, wherein said first controller is positioned for selectively coupling said motor to said power module for rotating said brushes, said first controller comprising a first button, said first button being depressible, wherein said first button is configured for depressing a first time for coupling said motor to said power module, wherein said first button is configured for depressing a second time for decoupling said motor from said power module, said first button being positioned on said handle proximate to said housing;

a plurality of bearings positioned in said internal space, each said bearing being coupled to and extending from a back of said housing, each said bearing being operationally coupled to an associated said pulley;

a plurality of pins, each said pin being axially coupled to and extending from said first face of a respective said disc;

a plurality of first holes, said first holes being complementary to said pins, each said first hole being axially positioned in a respective said pulley;

a plurality of second holes positioned through said front of said housing; each said second hole being aligned with a respective said first hole, wherein said second holes are positioned through said front of said housing such that each said second hole is positioned for inserting a respective said pin through said second hole into said first hole for reversibly coupling a respective said disc to a respective said pulley;

a plurality of tabs, each said tab being coupled to and extending from a respective said pin distal from said disc;

a plurality of slots, each said slot extending from a respective said second hole, said slots being complementary to said tabs, wherein said slots are positioned on said second holes such that each said slot is positioned for inserting a respective said tab as said pin is inserted through said respective said second hole;

at least one orifice positioned through said front of said housing;

a dispenser coupled to said housing and positioned in said internal space, said dispenser being fluidically coupled to said at least one orifice, said dispenser being configured for selectively compelling liquid soap through said at least one orifice, wherein said dispenser is positioned in said housing such that said dispenser is configured for selectively compelling the liquid soap through said at least one orifice, said dispenser comprising a pump operationally coupled to said power module, said pump being fluidically coupled to said second chamber and said at least one orifice, wherein said pump is positioned in said housing such that said pump is positioned for compelling the liquid soap from said second chamber through said at least one orifice to said front of said housing such that the liquid soap is configured for lathering a user;

a second controller operationally coupled to said pump and said power module, wherein said second controller is positioned for selectively coupling said pump to said power module for compelling the liquid soap from said second chamber through said at least one orifice to said front of said housing such that the liquid soap is configured for lathering the user, said second controller comprising a second button, said second button being depressible, wherein said second button is configured for depressing for coupling said pump to said power module, wherein said second button is configured for being released for decoupling said pump from said power module, said second button being positioned on said housing proximate to said handle, said second button being opposingly positioned relative to said first button;

a first penetration positioned though an end of said handle distal from said housing, said first penetration opening into said first chamber, wherein said first penetration is positioned in said handle such that said first penetration is configured for accessing said first chamber for servicing said power module, said first penetration being circularly shaped, said first penetration being internally threaded;

a first cap complementary to said first penetration, said first cap being reversibly couplable to said handle for selectively opening and closing said first penetration;

a slit positioned in said first cap, said slit being complementary to a standard screw driver head, wherein said slit is positioned in said first cap such that said slit is configured for inserting the head of the standard screw driver for reversibly coupling said first cap to said handle;

a second penetration positioned though said end of said handle, said second penetration opening into said second chamber, wherein said second penetration is positioned in said handle such that said second penetration is configured for inserting the liquid soap into said second chamber, said second penetration being circularly shaped, said second penetration being internally threaded;

a second cap complementary to said second penetration, said second cap being reversibly couplable to said handle for selectively opening and closing said second penetration;

a knob coupled to said second cap, said knob having a circumference, said circumference being textured such that said circumference is configured for frictionally coupling to one or more digits of a hand of the user, wherein said knob is positioned on said second cap such that said knob is configured for grasping by the one or more digits of the hand of the user for reversibly coupling said second cap to said handle; and wherein said pulleys are positioned on said brushes such that each said brush is positioned for rotating coincidently with said associated said pulley, wherein said first button is positioned for depressing the first time for coupling said motor to said power module, wherein said belt is positioned on said drive wheel and said pulleys such that said motor is positioned for compelling said brushes for rotating coincidently with said drive wheel, wherein said first button is positioned for depressing the second time for decoupling said motor from said power module, wherein said second button is positioned for depressing for coupling said pump to said power module such that said pump is positioned for compelling the liquid soap from said second chamber through said at least one orifice to said front of said housing such that the liquid soap is configured for lathering the user, wherein said second button is positioned for being released for decoupling said pump from said power module.

* * * * *